US008448279B2

(12) United States Patent
Cook

(10) Patent No.: US 8,448,279 B2
(45) Date of Patent: May 28, 2013

(54) ECOLOGICALLY-SOUND WATERWAY CULVERT RESTORATION

(76) Inventor: Terrace W. Cook, Troutdale, OR (US)

( * ) Notice: Subject to any disclaimer, the term of this patent is extended or adjusted under 35 U.S.C. 154(b) by 60 days.

(21) Appl. No.: 12/948,561

(22) Filed: Nov. 17, 2010

(65) Prior Publication Data

US 2012/0117739 A1 May 17, 2012

(51) Int. Cl.
*E02D 29/00* (2006.01)

(52) U.S. Cl.
USPC ..... 14/77.1; 14/26; 405/16; 405/262

(58) Field of Classification Search
CPC ..... E01D 21/00; E02B 3/00
USPC ..... 14/26, 78, 77.1, 73; 405/16, 18, 405/262, 284, 302.4, 302.6
See application file for complete search history.

(56) References Cited

U.S. PATENT DOCUMENTS

| | | | | | |
|---|---|---|---|---|---|
| 3,922,832 | A * | 12/1975 | Dicker | 52/741.15 |
| 3,956,788 | A * | 5/1976 | Nagin | 14/73 |
| 3,999,391 | A * | 12/1976 | Meredith | 405/259.5 |
| 4,043,133 | A * | 8/1977 | Yegge | 405/239 |
| 4,535,498 | A * | 8/1985 | Webster | 14/18 |
| 4,729,691 | A * | 3/1988 | Sample | 405/21 |
| 4,815,897 | A * | 3/1989 | Risi et al. | 405/284 |
| 4,911,582 | A * | 3/1990 | Peirce et al. | 405/262 |
| 5,125,765 | A * | 6/1992 | Verble | 405/31 |
| 5,174,897 | A * | 12/1992 | Wengrzynek | 210/602 |
| 5,549,418 | A * | 8/1996 | Devine et al. | 405/258.1 |
| 5,823,716 | A * | 10/1998 | Dray et al. | 405/258.1 |
| 5,934,027 | A * | 8/1999 | Khalili | 52/167.1 |
| 7,263,736 | B2 * | 9/2007 | Goodman et al. | 14/18 |
| 7,415,746 | B2 * | 8/2008 | Tao | 14/77.1 |
| 2002/0108348 | A1 * | 8/2002 | Yukimoto et al. | 52/747.12 |
| 2003/0143026 | A1 * | 7/2003 | Santha | 405/15 |
| 2006/0159526 | A1 * | 7/2006 | Bonasso | 405/284 |
| 2007/0009327 | A1 * | 1/2007 | Sanguinetti | 405/115 |
| 2007/0053752 | A1 * | 3/2007 | Kim | 405/284 |
| 2007/0269273 | A1 * | 11/2007 | Henderson | 405/239 |
| 2008/0008539 | A1 * | 1/2008 | Alter et al. | 405/232 |
| 2008/0092461 | A1 * | 4/2008 | Kim | 52/169.4 |
| 2008/0247685 | A1 * | 10/2008 | Kim | 383/113 |
| 2010/0129163 | A1 * | 5/2010 | Suematsu et al. | 405/229 |
| 2011/0064528 | A1 * | 3/2011 | Wang | 405/302.7 |

FOREIGN PATENT DOCUMENTS

JP 2008-267567 * 11/2008

* cited by examiner

*Primary Examiner* — Raymond W Addie
(74) *Attorney, Agent, or Firm* — Mersenne Law LLC

(57) ABSTRACT

Stabilized, durable stream crossings are built from contained plant growth medium secured to the stream banks, bridge footings installed behind the contained growth medium, and an open-construction bridge deck spanning the footings that permits light and rain water to reach the growth medium on the banks underneath the bridge.

3 Claims, 4 Drawing Sheets

ECOLOGICALLY-SOUND WATERWAY CULVERT RESTORATION

FIELD

The invention relates to waterway restoration at road/pedestrian crossings. More specifically, the invention concerns techniques and structures for building biologically beneficial, durable, low-environmental-impact waterway crossings.

BACKGROUND

Many areas of the United States (and other parts of the world) are crisscrossed by streams, creeks, brooks, sloughs, rivulets and other small waterways. These features are an important part of their local riparian ecosystems, but in many locations, the channels impede vehicular traffic. To address this problem, culverts—consisting frequently of a small-diameter steel, concrete or fiberglass/plastic tube—are installed to direct water under a road, railway bed or pedestrian crossing. FIG. 2 shows a typical half-pipe galvanized steel culvert: a corrugated steel sheet 200 is placed over a stream 210, and soil is placed over the sheet (220, generally) to build up the grade so that road 230 can cross.

Culverts are usually sized based on statistically-expected water flows based on known storm events to reduce the chance that they will be overfilled in a flood, but their size is often smaller than that of the natural stream bed, leading to an increase in water velocity and volume that frequently results in stream bank erosion at either side. In fact, culverts are often built with strong concrete entrances, as shown in FIG. 3, to protect the culvert from damage, but this often causes a "necking down" or "funneling" effect that threatens the banks upstream with erosion from flooding conditions and the bed and banks downstream of the culvert with scouring due to the increased velocity of the water exiting the culvert. Increased erosion can result, leading to recessed pools on the downstream side of a culvert (FIG. 4).

Culverts also adversely affect the passage of wildlife from one side to the other: terrestrial animals may have to walk over the road or track (rather than along the stream bank), and aquatic animals may be reluctant to swim through the culvert because it presents different and unexpected visual cues that inhibit them from entering. Further, if erosion and hydraulic scouring have caused the downstream portion of the waterway to recede from the culvert outlet, a condition called "perching," it may be impossible for fish to leap up to the culvert on their journey upstream. With the increased water velocity resulting from the funneling of the waterway into a constrained pipe, migrating and spawning fish such as steelhead and salmon may find it impossible to swim against the current preventing further migration upstream. The effect on non-aquatic wildlife passage is to force them to cross the road resulting in increased risk of harm to animals and significant loss to vehicles and even human lives.

Alternative structures that address some of these shortcomings may be useful when existing culverts must be repaired or replaced, and when new stream crossings are to be built.

SUMMARY

Culvert substitutes or replacements built with a native plant vegetated and structurally stabilized stream bank, reinforced bridge footing and a light and water-transmitting bridge deck can reduce stream bank erosion and waterway silting, and provide improved, safer access to animals and fish living near or in the waterway.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

DETAILED DESCRIPTION

Embodiments of the invention comprise features designed to address the shortcomings of traditional concrete-, steel- or fiberglass/plastic-tube culverts. Instead of installing the smallest practical passage that supports a minimum required water flow volume, embodiments focus on maintaining the natural slope, curve and height of the stream bank and width of the stream channel, while strengthening and stabilizing the bank so that native plantings can flourish and vehicular traffic can pass safely. A final feature of an embodiment is the open grid construction of the bridge deck, which permits rain and light to reach the stream and plantings on the engineered banks. These features combine to reduce the impact of the stream crossing on the passage of fish and other organisms, and the susceptibility of the structure or its adjoining unengineered surroundings to environmental damage.

Figure 1:
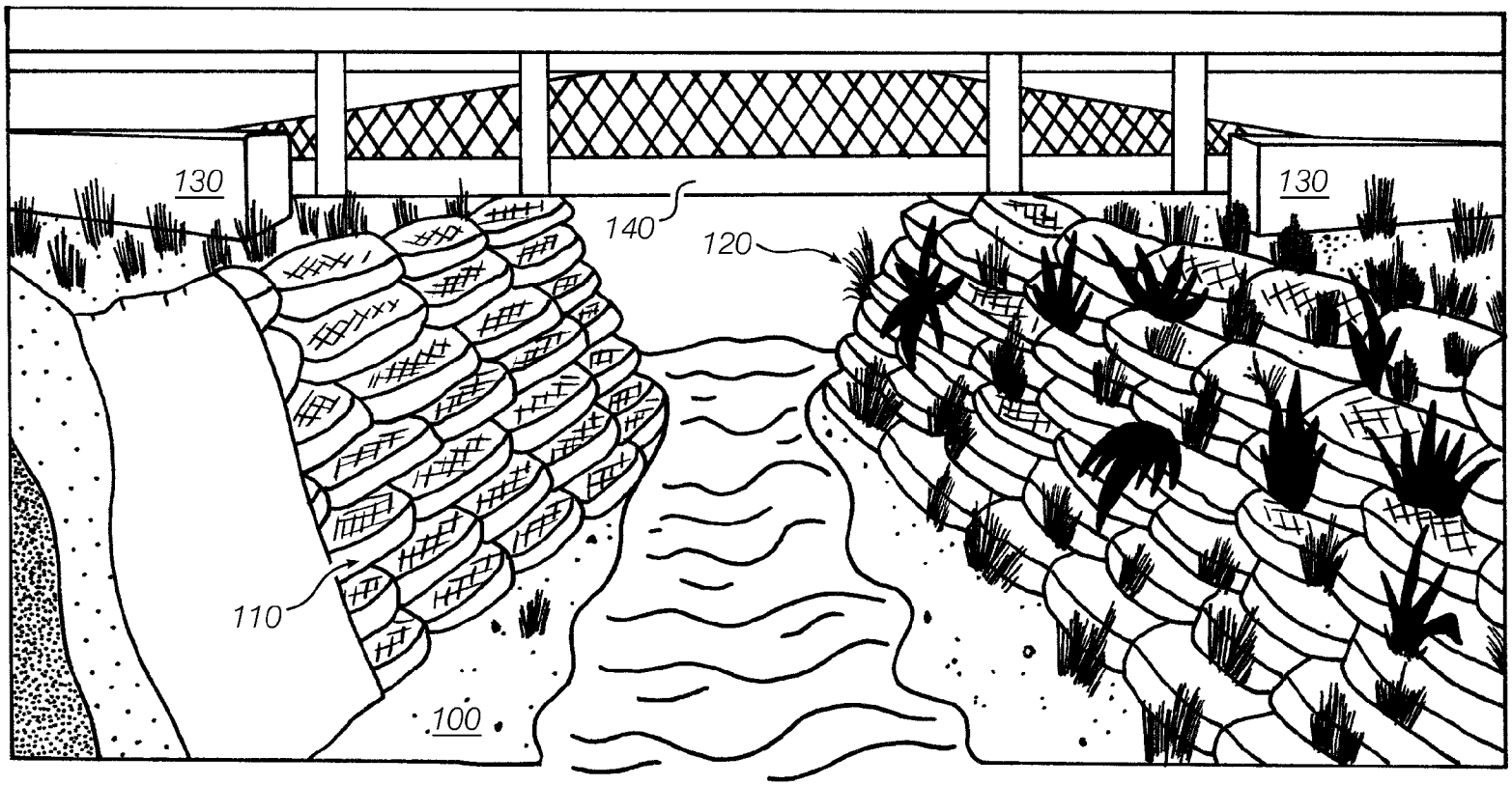
FIG. 1 shows several features of a stream crossing built according to an embodiment of the invention.
Figure 2:
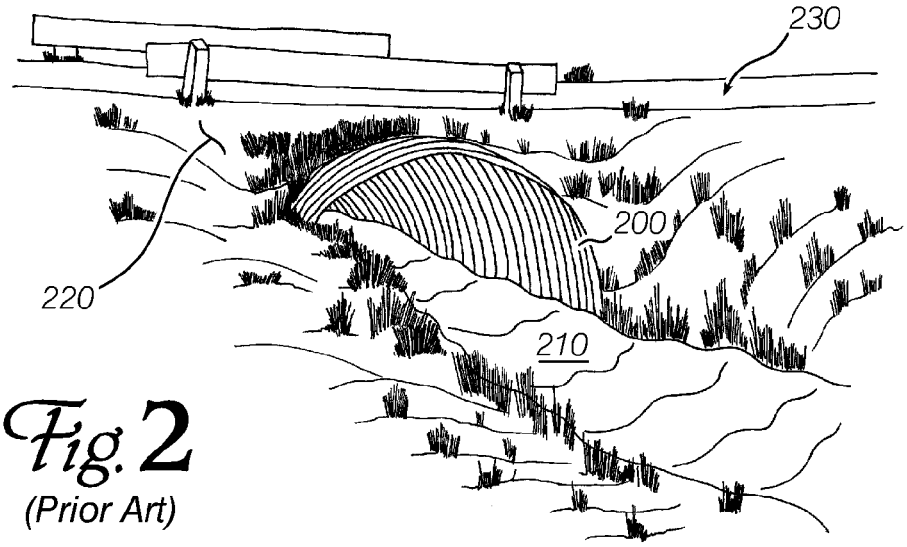
Fig. 2 (Prior Art)
FIG. 2 shows a typical, prior-art culvert.
Figure 3:
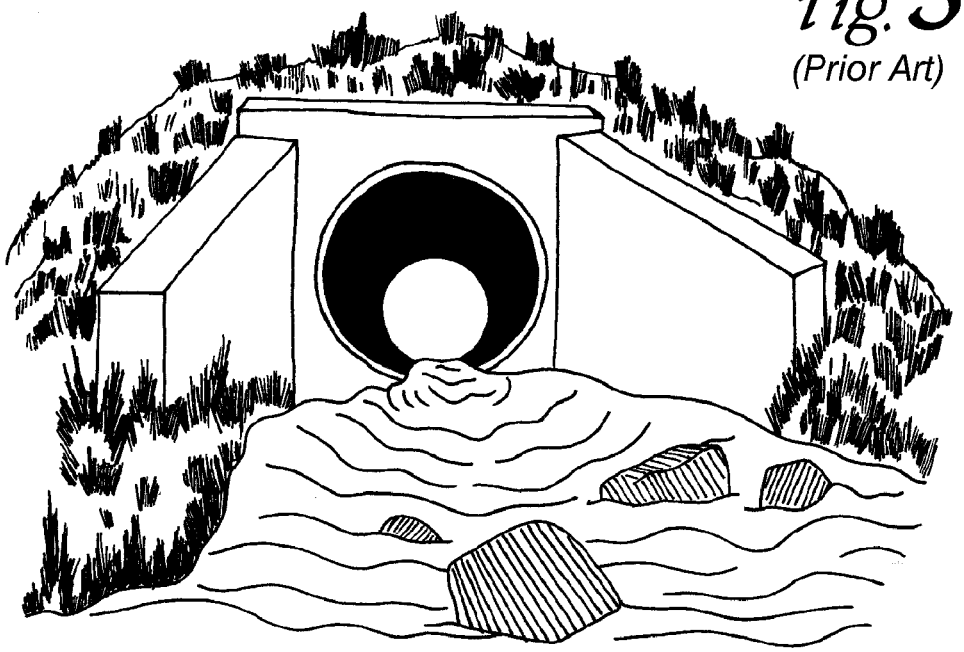
Fig. 3 (Prior Art)
FIG. 3 shows a detail of the entrance of a prior-art culvert.
Figure 4:
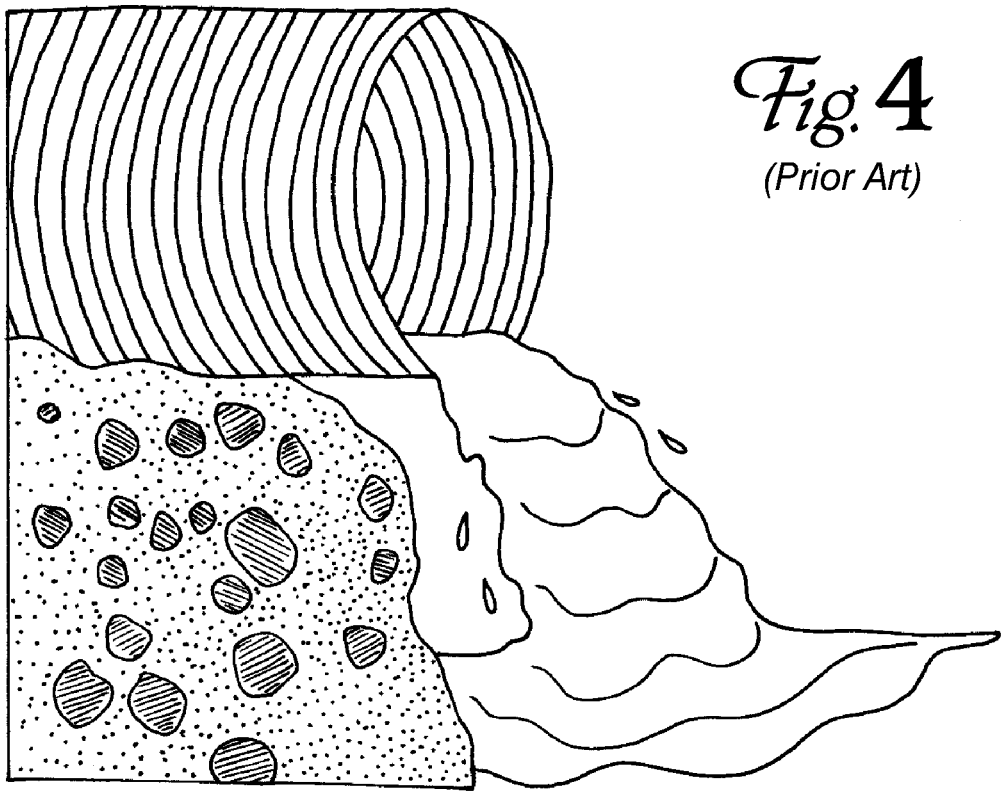
Fig. 4 (Prior Art)
FIG. 4 shows an example of erosion on the downstream side of a prior-art culvert.

FIG. 1 shows a general perspective view of a stream crossing constructed according to an embodiment of the invention. Several portions are depicted in cut-away form, or shown with overlying elements removed, so as to indicate relationships between functional parts. At the bottom of the scene lies the riverbed 100, which may be a natural pebble, rock or sand watercourse, or a previously-installed cement floor. In some embodiments, the riverbed may be constructed to form a shallower, faster-flowing section with increased turbulence (a "riffle"). Riffles are important to the development of some aquatic species. It is appreciated that other riverbed features, such as runs and pools, may also be added or incorporated when these are beneficial to the animals that live in or around the waterway.

Before constructing a crossing, the banks may be in their natural state, may have been eroded and degraded by previous hydraulic scouring episodes or may have been built using rock riprap with no biological application. In the vicinity of the stream crossing, the banks will be repaired (if necessary) and stabilized by installing geosynthetic bags 110 (described below) filled with rock as a foundation course with additional layers or courses of bags filled with plant growing medium such as a mixture of sand, soil and organic material. The geosynthetic bags are themselves knit together using spikes, ties or other connectors. This structure is designed to support the growth of vegetation 120, so the bank develops into a living retaining wall. Thus, the bank remains stable even after the initially-installed materials degrade or break down.

Behind the stabilized bank, modular or pre-cast concrete footings 130 are placed to support the road bed and bridge, and to anchor horizontal ties of geosynthetic mats to the stream bank walls. In some embodiments, post-tension compatible blocks with integral chaseways for buried utilities may be used.

Finally, a grate or mesh-deck bridge panel 140 is laid across the stream from footing to footing and secured. Unlike prior-art culverts and small bridges, stream crossings according to embodiments of the invention permit substantial amounts of light and water to pass through the bridge. This improves the prospects for robust plant growth on the stabilized banks and consequently the biological diversity and durability of the crossing. It also interferes less with the visual cues which fish rely on in their migratory travels, which may improve fish migration.

In an embodiment with a longer span distance, a single grate bridge panel may be unable to support the full design load. In this situation, a multi-span bridge, with shorter, grated panels near the banks, and solid or grated panels spanning abutments or cutwaters installed in the stream, achieves the goals of promoting plant growth along the banks under the bridge and admitting light to at least some areas of the stream under the bridge.

In some embodiments, one or both banks can be constructed with a horizontal path area (along the stream) to improve access for wildlife. In addition, the stream bed may be modified to contain natural (rock) or artificial (e.g. concrete) barriers to redirect water flow slightly, thus reducing the chance that statistical high-water events and flooding will damage the stabilized banks or other portions of the crossing.

Figure 5:
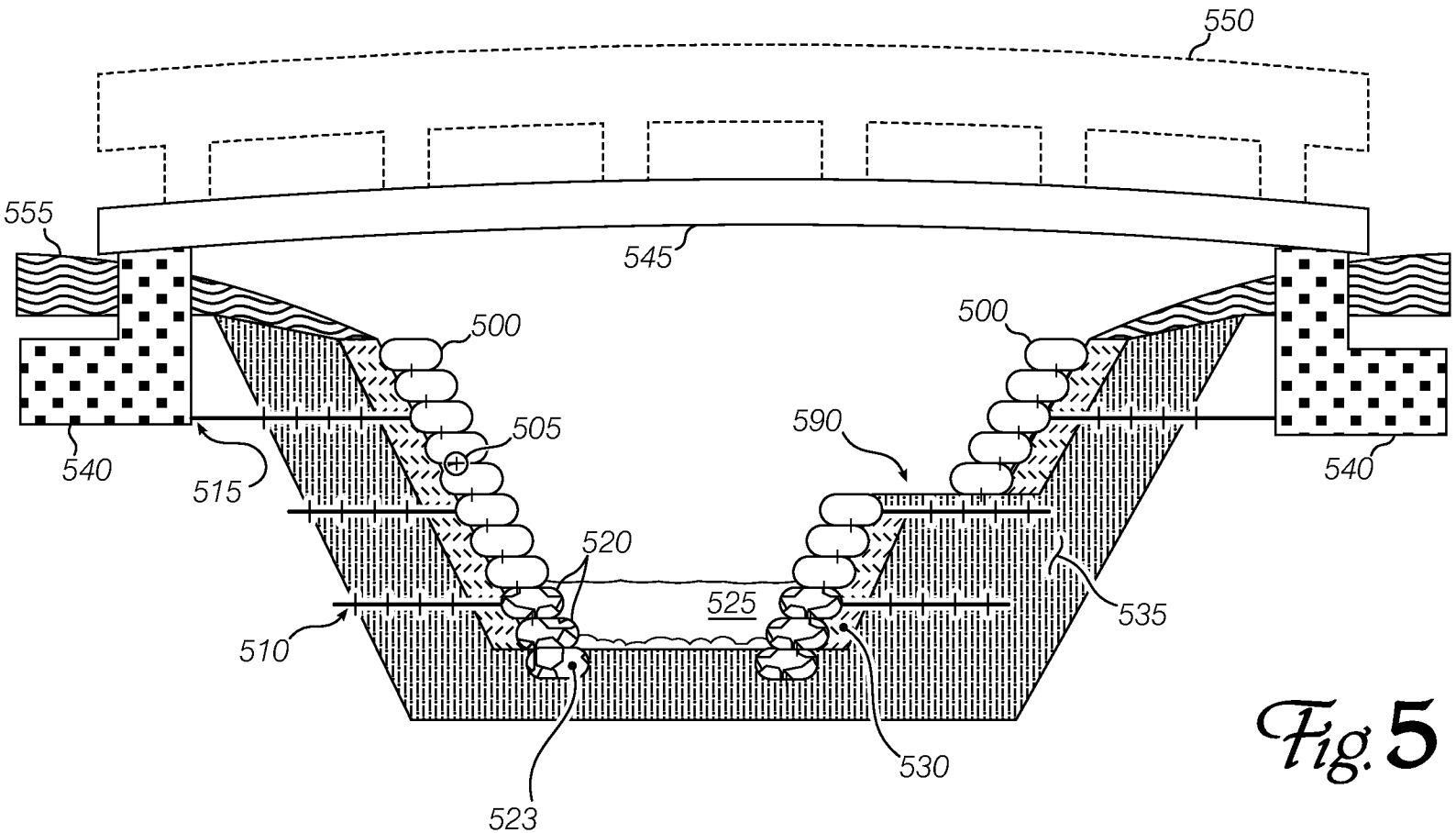
FIG. 5 shows a bank-stabilization structure that can be used with an embodiment of the invention.

FIG. 5 shows a section through a stream crossing according to an embodiment of the invention. The stream channel is generally in a 'V' shape with a flattened or truncated bottom. The sides of the channel are lined with geosynthetic bags 500, which are tied together vertically using stakes, spikes, ties or other means (represented schematically in this Figure as short vertical lines, circled at 505). Bags 500 are also secured by horizontal connectors 510 to keep them from being washed away from the (re-)constructed channel or from slumping into the stream bed. Connectors 510 may be, for example, barbed or knotted structures that are substantially uni-dimensional (like cords or stakes), or two-dimensional grids, meshes or sheets designed to resist forces pulling the bags 500 away from the channel wall. Some connectors may be secured to other parts of the structure, as shown at 515. Various methods of securing the bags are known in the related art of constructing retaining walls. For example, U.S. patent application Ser. No. 11/673,478 by Graham et al. describes one system that can be applied to embodiments of this invention.

Geosynthetic bags 520 that are below the normal water level (water shown at 525) may be filled with rocks or similar durable materials and tied into the geosynthetic bags above them. The rock-filled bags form foundation courses, and the bottom-most course or courses may be dug into the existing streambed to provide additional stability and anchoring effect (see, e.g., 523).

A granular backfill material or free-draining native soil may be used behind geosynthetic bags 500, as shown at 530. Behind the material at 530, the stream channel consists principally of reinforced backfill, compacted appropriately to meet applicable engineering requirements. (For example, requirements related to the load-bearing capacity of the road.)

At the location in the reconstructed stream channel where the road is to cross, concrete (or similar) footings 540 are located to support bridge deck 545. The bridge may have guard rails 550 or other structures, such as Americans with Disabilities Act ("ADA")-compliant walkways, utility crossings or crossings for waterlines, attached to it. Finally, in this Figure, topsoil 555 is shown capping the channel structure to support the growth of plants at the top of the bank. Other products such as EarthLite Filter Media from Sunmark Environmental Services of Portland, Oreg. can be used to filter stormwater runoff prior to entering the waterway. Note that the culvert replacement shown here comprises a small horizontal step 590, partway up the right-hand bank, to serve as an access route for wildlife to cross under the roadway Bridge 545 may be implemented in a wide range of different forms, depending upon the distance to be spanned, the necessary load-carrying capacity, environmental conditions that must be withstood, and so on. For small, short and light-duty crossings (e.g., foot-traffic and light vehicle load ratings) continuous or simple spans, in deck and pony configurations, may be relatively inexpensive and satisfactory choices. More complex structures, such as cantilevers or arches, may be required when the distance to be crossed is greater or load ratings are higher. In any embodiment, it is preferable that the bridge structure, including the travel surface, permit as much light and rainfall as possible to reach the stabilized banks and stream bed underneath. In many instances, a reinforced steel mesh or grid will provide sufficient strength to meet load requirements, while allowing light and rain water to reach plants on the bank under the bridge. Lighter-duty bridge decks may be constructed of an open wood or plastic grid.

The stream-crossing systems described above use a plurality of geosynthetic bags, secured against movement, to form a stable, durable retaining wall at the stream-bank surface. The bags may be made of Mirafi® 160 cloth, a durable, needlepunched, nonwoven geotextile composed of polypropylene fibers, which are formed into a stable network such that the fibers retain their relative position; or a similar durable synthetic and filled with rock for foundations, growing media for plants and/or EarthLite Filter Media for stormwater filtering The bags are non-biodegradable and resist abrasion, light damage and leakage, while the filling provides a soil-like medium to support plant growth and filter stormwater. Since the bag covering is porous, the banks can be planted efficiently and effectively by planting native plants as part of the wall construction process and/or hydroseeding (hydraulic spraying of plant seeds in a liquid carrier) over the top when complete. Alternatively, the bag filling can be blended with selected native plant seeds during manufacture; the seeds will germinate when the bags are exposed to water and light after installation. In most installations, hydroseeding is preferred to placing seeds in the bags during manufacture.

In some embodiments, the bag filling is a soil amendment product such as that described in the commonly-owned co-pending patent application Ser. No. 12/877,979. In such an embodiment, the filling provides nutrients and other support ingredients to help establish a first generation of plants growing along the reconstructed stream bank. These plants consume some of the filling materials, but return similarly-functional materials to the stream bank when they die, so the entire installed system can become self-sustaining. Plants growing along the stream bank help resist damage and erosion due to rain and flood water flows.

In the preceding description, numerous details were set forth. It will be apparent, however, to one skilled in the art, that the present invention may be practiced without some of these specific details. In some instances, well-known structures and devices are shown in block diagram form, rather than in detail, in order to avoid obscuring the present invention.

The applications of the present invention have been described largely by reference to specific examples and in terms of particular allocations of functionality to certain structures or formations. However, those of skill in the art will recognize that durable, sustainable and environmentally-friendly stream crossings can also be constructed as embodiments comprising subsets of the features described, or by using alternate techniques to achieve the same ends. Such variations and implementations are understood to be captured according to the following claims.

I claim:

1. A method of constructing a culvert, comprising:

compacting soil of a stream bank at a desired crossing point;

embedding bridge footings in the soil;

laying courses of geotextile bags containing plant growth medium to form a retaining wall on the stream bank;

securing at least some of the geotextile bags to other geotextile bags;

securing at least some of the geotextile bags to the bridge footings; and placing a water- and light-passing bridge deck to span between the bridge footings.

2. The method of claim 1, further comprising:

planting the retaining wall by hydroseeding.

3. The method of claim 1 wherein the bridge footings are post-tension-compatible blocks with integral utility chaseways.

* * * * *